United States Patent [19]

King

[11] Patent Number: 4,476,700

[45] Date of Patent: Oct. 16, 1984

[54] BOLT LOCK FOR A SLIDING PATIO DOOR

[76] Inventor: David L. King, 8626 54th Pl. West, Mukilteo, Wash. 98275

[21] Appl. No.: 407,653

[22] Filed: Aug. 12, 1982

[51] Int. Cl.[3] ..... E05B 25/08

[52] U.S. Cl. ..... 70/99; 70/120; 292/39

[58] Field of Search ..... 292/39, 142, DIG. 51; 70/82, 95, 99, 100, 118, 120

[56] References Cited

U.S. PATENT DOCUMENTS 3,563,068 2/1971 Dushane ..... 70/100

FOREIGN PATENT DOCUMENTS

| | | | |
|---|---|---|---|
| 733665 | 3/1943 | Fed. Rep. of Germany | 292/39 |
| 1021271 | 12/1957 | Fed. Rep. of Germany | 292/39 |
| 1950153 | 6/1970 | Fed. Rep. of Germany | 292/39 |
| 717401 | 10/1931 | France | 292/39 |
| 369736 | 3/1932 | United Kingdom | 292/39 |

*Primary Examiner*—Robert L. Wolfe

[57] ABSTRACT

This bolt lock is for a sliding patio door. Primarily, it consists of a housing containing a lock mechanism for the outward and inward travel of a pair of toothed lock bolts, which are slideably received between a pair of side frames of said housing. It also includes a sector gear and a small gear, which serve to advance and retract said pair of toothed lock bolts, simultaneously, when the lock cylinder of the combination is turned by a key.

2 Claims, 3 Drawing Figures

BOLT LOCK FOR A SLIDING PATIO DOOR

This invention relates to security locks, and more particularly, to a bolt lock for a sliding patio door.

The principal object of this invention is to provide a bolt lock for a sliding patio door, which will be designed to fit into the interior of an aluminum sliding patio door framework.

Another object of this invention is to provide a bolt lock for a sliding patio door, which will be intended to work in conjunction with existing patio door hardware.

A further object of this invention is to provide a bolt lock for a sliding patio door, which will include sector gear means, for key operated advancing and retracting of the lock bolt means.

Other objects are to provide a bolt lock for a sliding patio door, which is simple in design, inexpensive to manufacture, rugged in construction, easy to use, and efficient in operation.

These, and other objects, will be readily evident, upon a study of the following specification, and the accompanying drawing, wherein.

Figure 1:
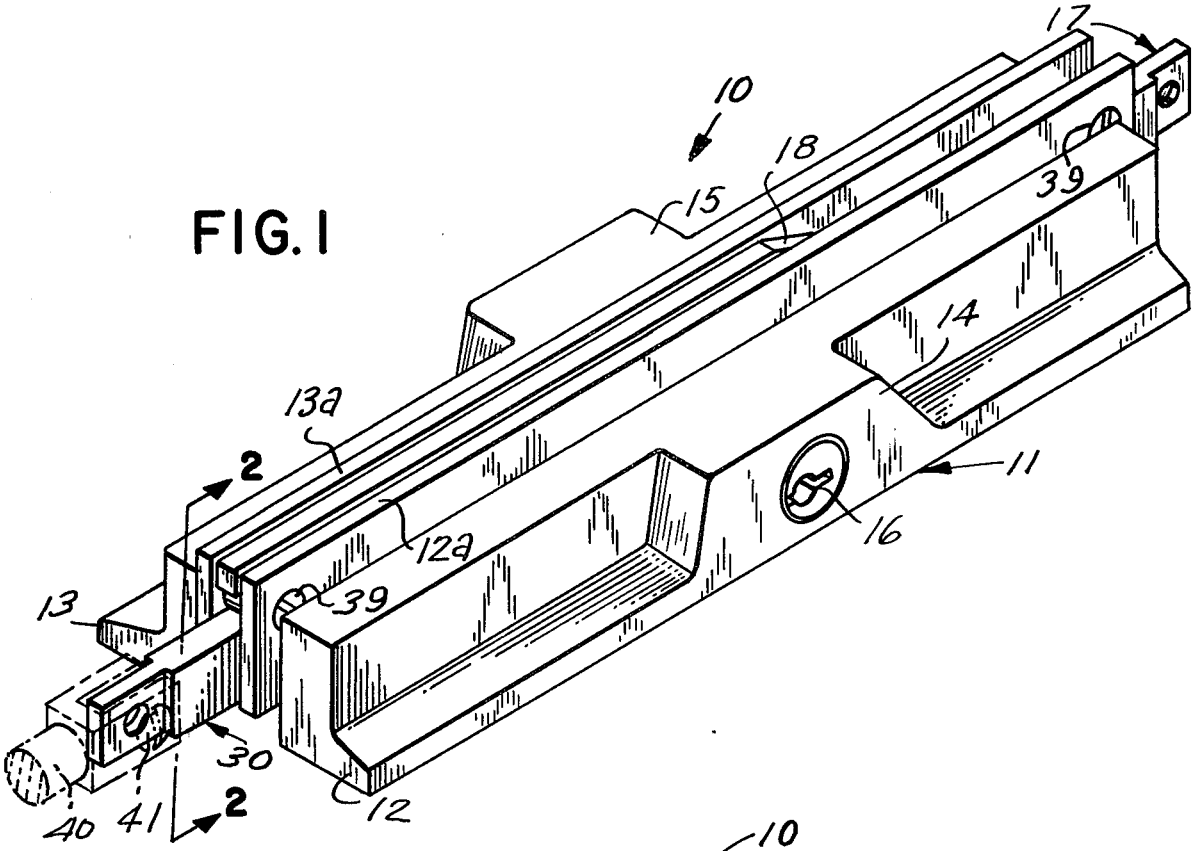
FIG. 1 is a perspective view of the present invention.
Figure 2:
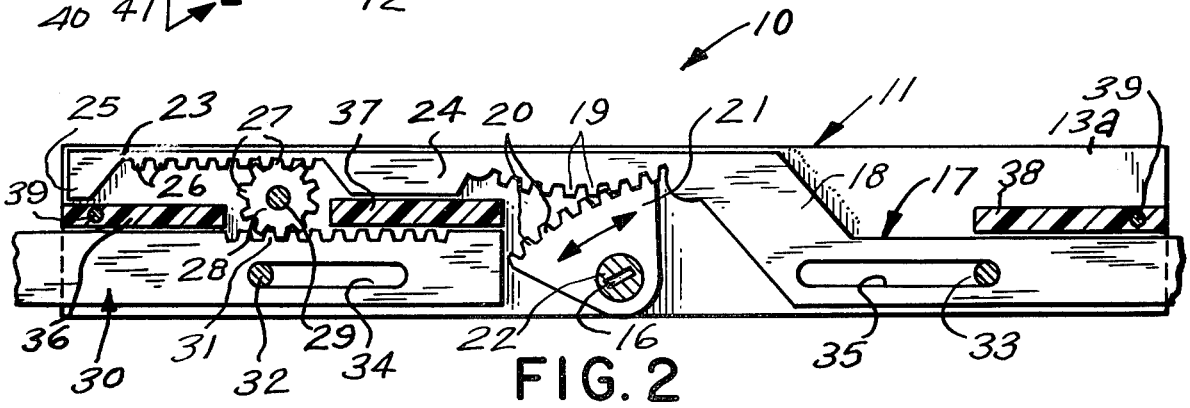
FIG. 2 is a cross-sectional view, taken along the line 2—2 of FIG. 1.

According to this invention, a lock 10 is shown to include a housing 11, which is composed of a pair of side members 12 and 13. Side members 12 and 13 are "L"-shaped in cross-sectional configuration, and include an integral portion 14 and 15, in which is located the lock mechanism, not shown, that will receive its key with the key slot 16. A bolt 17 includes an off-set portion 18, which includes a plurality of teeth 19 on an arcuate curve, which engage with the teeth 20 of a sector gear 21. Sector gear 21 is secured stationary to lock shaft 22, so as to be rotated when the key is received and rotated within the key slot 16. An extension portion 23, of off-set portion 18 of lock bolt 17, includes a projection portion 24, spaced from a second projection portion 25 at one end of bolt 17, and the intermediate area, between projection portions 24 and 25, includes a plurality of teeth 26, which engage with the teeth 27 of gear 28, which is fixedly secured to a shaft 29 by suitable fastening means, not shown. A second bolt 30 is also received with housing 11, and includes a plurality of teeth 31, which also engage with teeth 27 of gear 28, which is fixedly secured to a shaft 29 by suitable fastening means, not shown. A second bolt 30 is also received with housing 11, and includes a plurality of teeth 31, which also engage with teeth 27 of gear 28, so as to enable both the bolts 17 and 30 to extend outwards from the ends of housing 11, simultaneously when lock 10 is operated by the key being rotated within the key slot 16. Sector gear 21 serves to operate both bolts 17 and 30 the same stroke distance, and a pair of pins 32 and 33 are fixedly secured between and in side frame members **12*a* and 13*a*, by suitable means. An elongated horizontal slot 34, through the second bolt 30, freely and slideably receives pin 32, and a similar slot 35 in bolt 17 freely and slideably receives pin 33, and both of the pins 32 and 33 serve to support their respective bolts 17 and 30, near their bottom longitudinal edges. The top longitudinal side edges of bolts 17 and 30 are slideable against guide strips 36, 37 and 38, which are fabricated of a suitable anti-friction plastic, for long unattended wear, and strips 36, 37 and 38 are fixedly secured to side frame members 12*a* and 13*a*, by suitable fasteners 39**.

It shall be noted, that lock shaft 22 extends through side frame members **12*a* and 13*a*, and the shaft 29 of gear 28, and the pins 32 and 33, also extend through and are fixedly secured in the side frames 12*a* and 13*a***.

The rods 40, one of which is shown, are suitably secured to the ends of both bolts 17 and 30 by suitable fasteners 41, for locking the bottom and top of the patio door.

In use, when a key is inserted in key slot 16 and rotated to the right, sector gear 21 will rotate to the right, and the teeth 20 of sector gear 21, engaging teeth 19 of bolt 17, will cause bolt 17 to move outwards of housing 11, and simultaneously, the teeth 26 of bolt 17, engaging with the teeth 31 of gear 28, will cause gear 28 to rotate and urge bolt 30 outwards of housing 11 in the opposite direction of bolt 17, thus locking the patio door. When the key is reversed in direction, the reverse takes place and causes the bolts 17 and 13 to retract from their locking positions.

Figure 3:
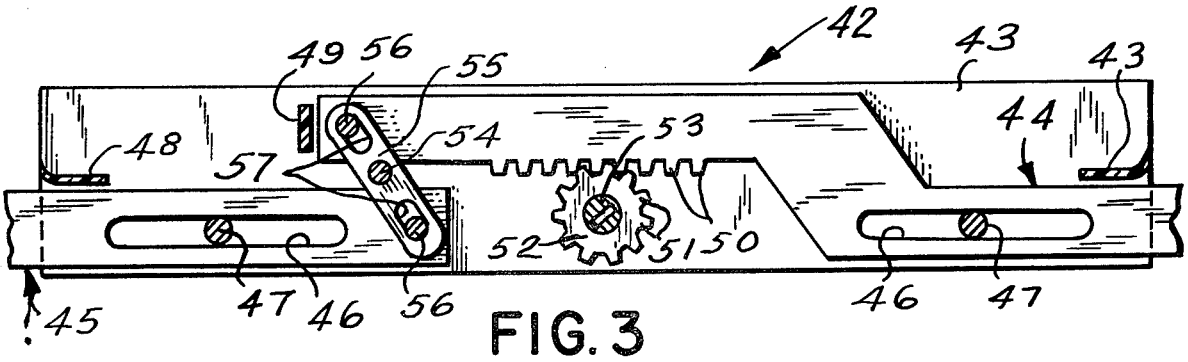
FIG. 3 is similar to FIG. 2, but illustrates a modified form of the invention.

Referring now to FIG. 3 of the drawing, a modified form of bolt lock 42 is shown to include a pair of side frames 43, between which a lock bolt 44 and 45 are received. Bolts 44 and 45 include elongated slots 46 therethrough, which freely and slideably receive pins 47, that are fixedly secured in side frames 43 in a suitable manner. A pair of anti-friction guide members 48 are fixedly secured to and between side frames 43 in a suitable manner, and serve as guide means against the top longitudinal edges of bolts 45 and 46. A suitable stop member 49 is fixedly secured between side frames 43, so as to engage with the end of bolt 44 when bolts 44 and 45 are fully retracted, or in the unlocked position. Bolt 44 includes a plurality of teeth 50, which engage with teeth 51 of gear 52, and gear 52 is suitably secured stationary to lock shaft 53, which is key operated in the same manner, heretofore described by lock 10. A pivot pin 54 is also fixedly secured to side frames 43, and mounts pivotal lever 55. The ends of lever 55 are received on pins 56, which extend from, and are fixedy secured to bolts 44 and 45 in a suitable manner. A slot 57, through each end of lever 55, freely and slideably receives the pins 56 when lock 42 is operated.

In use, lock 42 functions in the same manner as was heretofore described of the main embodiment of the invention, with the exception, that lever 55 is used to transmit the opposite direction motions of bolt 45, with respect to the bolt 43 of lock 42.

It shall also be noted, that in cases of double cylinder protection when a keyed lock cylinder is on both sides of the patio door, the inside handle must be replaced to match the exterior handle. When the lock is locked with either key or thumb latch, the bolts from the interior lock are extended one inch from the top and bottom of the sliding door, to prevent the door from being jimmied open. The lock is easily installed, and the bolts are field-cut to fit different door heights.

It shall further be noted, that the sector gear must be replaced, to change from single cylinder to double cylinder operation for security protection.

While various changes may be made in the detail construction, it is understood that such changes will be within the spirit and scope of the present invention, as is defined by the appended claims.

What I now claim is:

1. A bolt lock for a sliding patio door, comprising, in combination, a housing comprising a pair of spaced-apart, cross-sectionally "L"-shaped side members having a lock cylinder mechanism therewithin, a pair of side frames between said side members, and a pair of slidable lock bolts, a rotatable sector gear and a rotatable small gear being all located between said side frames; a rotatable transverse lock shaft between said side members engaging said lock cylinder mechanism, a key-receiving slot in one end of said lock shaft, said sector gear being affixed on said lock shaft, a transverse shaft between said side frames, said small gear being affixed on said transverse shaft, one of said lock bolts having an arcuately curved tooth rack and also a straight toothed rack along its side edge, said arcuately curved tooth rack engaging said sector gear, said straight toothed rack being engagable with said small gear, and said small gear engaging a single, straight toothed rack on the other said lock bolt.

2. The combination as set forth in claim 1, wherein said lock cylinder mechanism includes means for being keyed on both sides of said door, and said lock bolts are extended from the top and the bottom of said door.

* * * * *